US010783728B1

(12) United States Patent
Mhaske et al.

(10) Patent No.: US 10,783,728 B1
(45) Date of Patent: Sep. 22, 2020

(54) SYSTEMS AND METHODS FOR CONTROLLING ACCESS

(71) Applicant: Symantec Corporation, Mountain View, CA (US)

(72) Inventors: Sharad Mhaske, Maharashtra (IN); Anuradha Joshi, Pune (IN)

(73) Assignee: NortonLifeLock Inc., Tempe, AZ (US)

( * ) Notice: Subject to any disclaimer, the term of this patent is extended or adjusted under 35 U.S.C. 154(b) by 0 days.

(21) Appl. No.: 16/227,535

(22) Filed: Dec. 20, 2018

(51) Int. Cl.

| | |
|---|---|
| ***G07C 9/27*** | (2020.01) |
| ***G07C 9/29*** | (2020.01) |
| ***G07C 9/25*** | (2020.01) |
| *G07C 9/26* | (2020.01) |

(52) U.S. Cl.
CPC ..... *G07C 9/27* (2020.01); *G07C 9/257* (2020.01); *G07C 9/29* (2020.01); *G07C 9/26* (2020.01)

(58) Field of Classification Search
CPC ..... G07C 9/00103; G07C 9/00087; G07C 9/00119; G07C 2009/00095
USPC ..... 235/382
See application file for complete search history.

(56) References Cited

U.S. PATENT DOCUMENTS

2011/0109426 A1* 5/2011 Harel ..... G06Q 50/10 340/5.6

OTHER PUBLICATIONS

Bauer et al., "Lessons Learned from the Deployment of a Smartphone-Based Access-Control System", CyLab, Carnegie Mellon University, Oct. 18, 2006, 16 pages.
Yadron, Danny, "Apple gets patent for remotely disabling iPhone cameras, raising censorship fears", The Guardian, Jun. 30, 2016, 3 pages.

* cited by examiner

*Primary Examiner* — Daniel A Hess
(74) *Attorney, Agent, or Firm* — FisherBroyles, LLP

(57) ABSTRACT

The disclosed computer-implemented method for controlling access may include (i) installing on a personal mobile device a mobile device application that enforces an authorization security policy for protected premises, (ii) checking, by the mobile device application and in response to installing the mobile device application, whether the personal mobile device satisfies a condition of the authorization security policy, (iii) granting authorization for the personal mobile device to function as an access card based on a result of checking whether the personal mobile device satisfies the condition of the authorization security policy, and (iv) enforcing an additional access security policy on the personal mobile device after granting authorization for the personal mobile device to function as the access card. Various other methods, systems, and computer-readable media are also disclosed.

20 Claims, 6 Drawing Sheets

SYSTEMS AND METHODS FOR CONTROLLING ACCESS

BACKGROUND

As empowering as smartphones and tablets can be, the proliferation of personal mobile devices in the workplace can nevertheless potentially trigger major corporate liability. Improperly monitored mobile devices in the workplace can result in data loss, regulatory compliance violations, and security breaches.

For example, a jail broken infected device connected to an office network can pose a significant security threat. Such security threats can be present not just in corporate environments, but also in home wireless network and access card security system environments. Accordingly, security systems with a "BRING-YOUR-OWN-DEVICE" component can provide an additional degree of freedom for users, but nevertheless such components may also create an inherent security risk.

In view of the security risks that can be posed by conventional systems, as described above, additional mobile device management systems may help to compensate for, and address, some of these security risks. Nevertheless, conventional mobile device management systems generally do not offer fine grained control, as discussed further below. For example, corporate security constraints may dynamically differ based on the specific location of the user device within the corporate premises. In some scenarios, several different sublocations (e.g., the server room, the mailroom, conference rooms, etc.) within the corporate premises may involve different security conditions. Some mobile device management systems may ensure that only authorized persons have access to a specific location within a corporate environment, however these systems may still suffer from the deficiency that the person's mobile device itself is still not verified or authorized. The instant disclosure, therefore, identifies and addresses a need for improved systems and methods for controlling access.

SUMMARY

As will be described in greater detail below, the instant disclosure describes various systems and methods for controlling access. In one example, a computer-implemented method for controlling access may include (i) installing on a personal mobile device a mobile device application that enforces an authorization security policy for protected premises, (ii) checking, by the mobile device application and in response to installing the mobile device application, whether the personal mobile device satisfies a condition of the authorization security policy, (iii) granting authorization for the personal mobile device to function as an access card based on a result of checking whether the personal mobile device satisfies the condition of the authorization security policy, and (iv) enforcing an additional access security policy on the personal mobile device after granting authorization for the personal mobile device to function as the access card.

In some examples, enforcing the additional access security policy on the personal mobile device includes dynamically enforcing a sublocation-specific condition within the protected premises protected by the mobile device application based on the mobile device application detecting that a location of the personal mobile device matches the sublocation-specific condition. In one embodiment, an external security server to which the personal mobile device connects does not consume information indicating a more specific and granular location of the personal mobile device than information indicating a sublocation that a user of the personal mobile device attempted to access using the personal mobile device as the access card.

In one embodiment, the additional access security policy specifies varying location-specific security conditions for differing locations within the protected premises protected by the mobile device application and the mobile device application applies the location-specific security conditions dynamically based on location information indicating a location of the personal mobile device that was detected by the personal mobile device. In one embodiment, the mobile device application applies the location-specific security conditions dynamically without providing the location information indicating the location of the personal mobile device to an external security server to protect the privacy of a user of the personal mobile device by keeping the location information contained within the personal mobile device rather than exposing the location information to the external security server.

In one embodiment, the additional access security policy specifies varying location-specific security conditions for differing locations within the protected premises protected by the mobile device application and the mobile device application prevents an external security server protecting the protected premises from consuming information indicating a location of the personal mobile device that is more specific than access card entry information. In one embodiment, the additional access security policy maps a specific location within the protected premises protected by the mobile device application to a security condition of disabling an input device of the personal mobile device. In one embodiment, the additional access security policy maps a specific location within the protected premises protected by the mobile device application to a security condition of disabling a wireless network component of the personal mobile device. In some examples, enforcing the additional access security policy is enabled through a push notification that is triggered through a local wireless network beacon. In one embodiment, the authorization security policy specifies a biometric security condition.

In one embodiment, a system for implementing the above-described method may include (i) an installation module, stored in memory, that installs on a personal mobile device a mobile device application that enforces an authorization security policy for protected premises, (ii) a checking module, stored in memory, that checks, as part of the mobile device application and in response to installing the mobile device application, whether the personal mobile device satisfies a condition of the authorization security policy, (iii) a granting module, stored in memory, that grants authorization for the personal mobile device to function as an access card based on a result of checking whether the personal mobile device satisfies the condition of the authorization security policy and, (iv) an enforcement module, stored in memory, that enforces an additional access security policy on the personal mobile device after granting authorization for the personal mobile device to function as the access card, and (v) at least one physical processor configured to execute the installation module, the checking module, the granting module, and the enforcement module.

In some examples, the above-described method may be encoded as computer-readable instructions on a non-transitory computer-readable medium. For example, a computer-readable medium may include one or more computer-executable instructions that, when executed by at least one processor of a computing device, may cause the computing device to (i) install on a personal mobile device a mobile device application that enforces an authorization security policy for protected premises, (ii) check, by the mobile device application and in response to installing the mobile device application, whether the personal mobile device satisfies a condition of the authorization security policy, (iii) grant authorization for the personal mobile device to function as an access card based on a result of checking whether the personal mobile device satisfies the condition of the authorization security policy, and (iv) enforce an additional access security policy on the personal mobile device after granting authorization for the personal mobile device to function as the access card.

Features from any of the embodiments described herein may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of example embodiments and are a part of the specification. Together with the following description, these drawings demonstrate and explain various principles of the instant disclosure.

Figure 1:
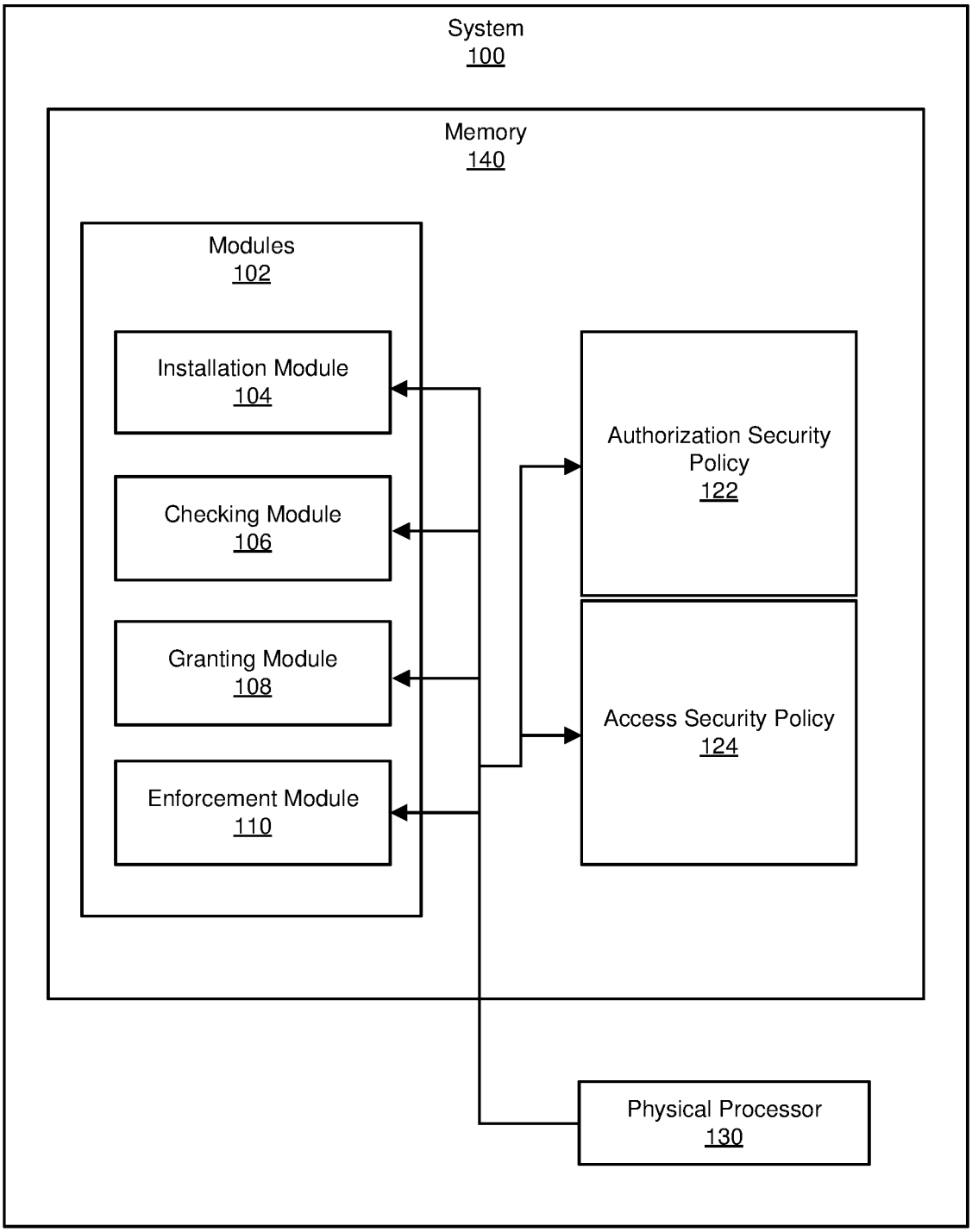
FIG. 1 is a block diagram of an example system for controlling access.

Throughout the drawings, identical reference characters and descriptions indicate similar, but not necessarily identical, elements. While the example embodiments described herein are susceptible to various modifications and alternative forms, specific embodiments have been shown by way of example in the drawings and will be described in detail herein. However, the example embodiments described herein are not intended to be limited to the particular forms disclosed. Rather, the instant disclosure covers all modifications, equivalents, and alternatives falling within the scope of the appended claims.

DETAILED DESCRIPTION OF EXAMPLE EMBODIMENTS

The present disclosure is generally directed to systems and methods for controlling access. The present disclosure generally combines, in a novel and inventive manner, smartphone-as-an-access-card technology with sublocation-specific dynamic on-premise security systems (e.g., security systems that dynamically specify one or more varying conditions on users and/or user devices depending on the specific location of the users within the overall premises protected by the security systems). In general, the disclosed subject matter may improve upon other systems by improving and enhancing the level of privacy protections that are afforded to users who bring their own personal mobile devices to function as access cards within protected environments. Typically, related systems may allow users to use their own personal mobile devices within a protected environment by connecting to one or more network servers, where the servers may subsequently detect location information of the personal mobile devices (and other information), and then the servers may dynamically apply one or more security policies based on this large amount of consumed information. In other words, these related systems may unnecessarily consume large amounts of information about users and their locations and behaviors within the protected premises, and therefore these related systems may pose substantial privacy concerns and regulatory liability concerns.

The concerns outlined above generally result from these security systems applying one or more security policies at the server level, whereby security servers have a high-level view of a large amount of information about users within the protected premises, and the security servers apply one or more security policies remotely. In contrast, the disclosed subject matter in this application may improve upon these related systems by first downloading and storing comprehensive security policies for the premises locally on the personal mobile device (e.g., sublocation-specific security policies that may be substantially or entirely parallel to, or the same as, comprehensive sublocation-specific security policies that were otherwise applied remotely at the server level, such as by a centralized security server, within related systems), verifying, approving, and/or registering the personal mobile device, and then trusting that the registered personal mobile device will locally apply these comprehensive security policies itself without necessarily involving one or more remote security servers.

The disclosed subject matter may enable a user to bring his or her own personal mobile device to function as an access card within protected premises without exposing additional, alternative, and/or more specific location information, and/or other behavior information, to an external security server and/or system outside of the local personal mobile device itself. By preventing this additional information from being exposed outside of the personal mobile device, the improved subject matter of this application may simultaneously establish and enforce security policies on the protected premises (e.g., security policies that are as comprehensive and sophisticated as security policies, including sublocation-specific and dynamic security policies, which were applied remotely at the server level in related systems) while also establishing and protecting a substantially higher and improved level of privacy regarding location, behavior, and/or other information for the users that is not necessary for the remaining security system, outside of the local personal mobile device, to consume in order to ensure that the overall security policy compliance mission for the protected premises is fulfilled.

Additionally, the disclosed subject matter also improves upon conventional access card security systems (e.g., simple and unintelligent magnetic key systems, hotel key card systems, etc.) by providing a much finer, more granular, and more sophisticated level of protections at the point of the access card by leveraging the additional technology and functionality that is provided by the user's own personal mobile device, such as a smartphone or tablet, which is a much greater and more sophisticated level of technology than these unintelligent conventional access card systems can provide. For example, unintelligent access card security systems cannot locally enforce (e.g., local at the point of the access card itself as distinct from a remote security server) comprehensive and dynamic sublocation-specific security policies and conditions. Moreover, even if related smartphone-as-an-access-card technologies also shared some of these benefits over conventional and unintelligent access card security systems, these related smartphone-as-an-access-card technologies still nevertheless suffered from the privacy shortcomings outlined above, which the disclosed subject matter herein overcomes, as discussed in more detail below.

Figure 2:
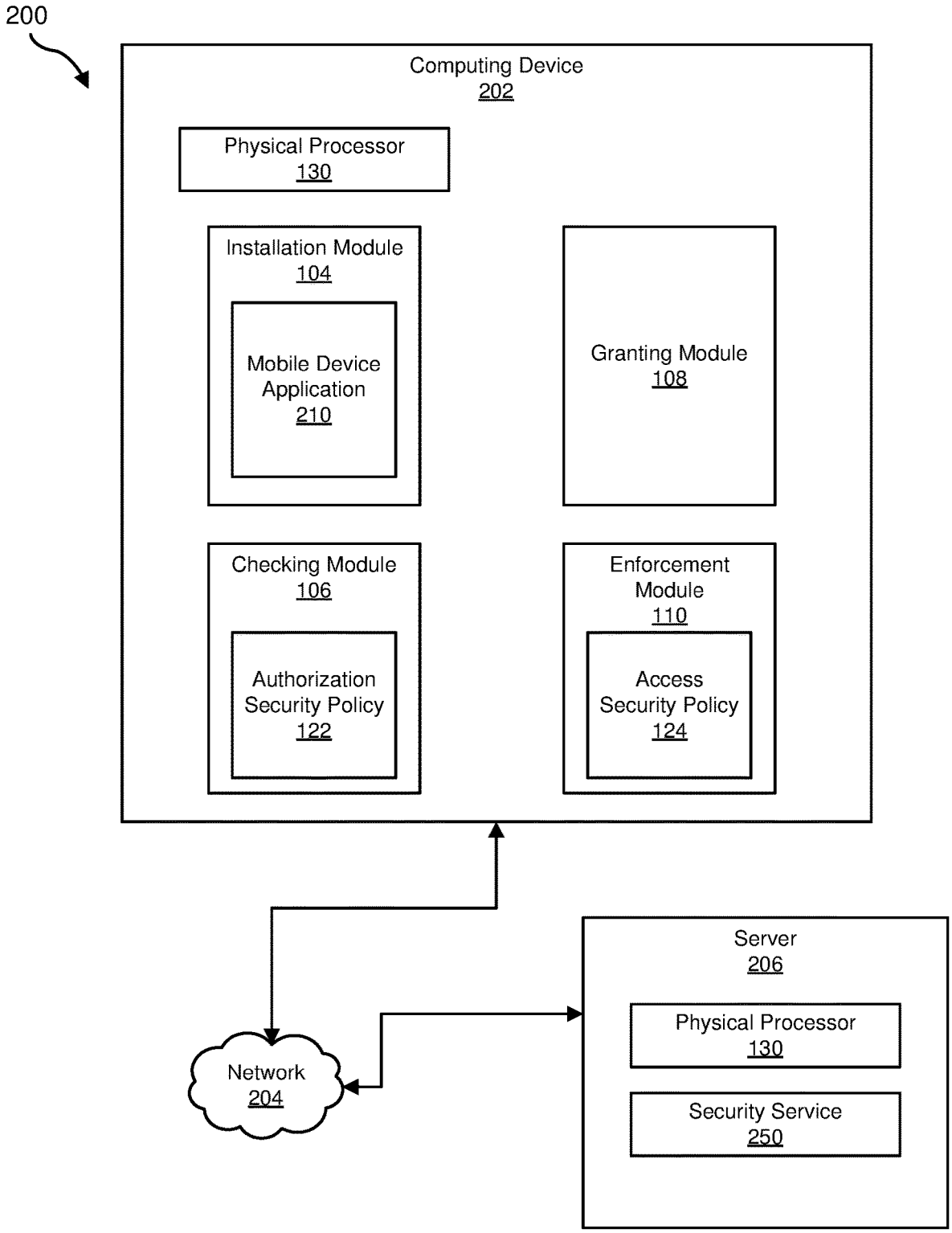
FIG. 2 is a block diagram of an additional example system for controlling access.

The following will provide, with reference to FIGS. 1-2, detailed descriptions of example systems for controlling access. Detailed descriptions of corresponding computer-implemented methods will also be provided in connection with FIGS. 3-4. In addition, detailed descriptions of an example computing system and network architecture capable of implementing one or more of the embodiments described herein will be provided in connection with FIGS. 5 and 6, respectively.

FIG. 1 is a block diagram of example system 100 for controlling access. As illustrated in this figure, example system 100 may include one or more modules 102 for performing one or more tasks. For example, and as will be explained in greater detail below, example system 100 may include an installation module 104 that installs on a personal mobile device, such as a computing device 202 discussed further below in connection with FIG. 2, a mobile device application that enforces an authorization security policy 122 for protected premises, such as a corporate or other organizational environment protected by an access card system, as discussed further below. Example system 100 may additionally include a checking module 106 that checks, as part of the mobile device application and in response to installing the mobile device application, whether the personal mobile device satisfies a condition of authorization security policy 122. Example system 100 may also include a granting module 108 that grants authorization for the personal mobile device to function as an access card based on a result of checking whether the personal mobile device satisfies the condition of the authorization security policy. Example system 100 may additionally include an enforcement module 110 that enforces an additional access security policy 124 on the personal mobile device after granting authorization for the personal mobile device to function as the access card. Although illustrated as separate elements, one or more of modules 102 in FIG. 1 may represent portions of a single module or application.

In certain embodiments, one or more of modules 102 in FIG. 1 may represent one or more software applications or programs that, when executed by a computing device, may cause the computing device to perform one or more tasks. For example, and as will be described in greater detail below, one or more of modules 102 may represent modules stored and configured to run on one or more computing devices, such as the devices illustrated in FIG. 2 (e.g., computing device 202 and/or server 206). One or more of modules 102 in FIG. 1 may also represent all or portions of one or more special-purpose computers configured to perform one or more tasks.

As illustrated in FIG. 1, example system 100 may also include one or more memory devices, such as memory 140. Memory 140 generally represents any type or form of volatile or non-volatile storage device or medium capable of storing data and/or computer-readable instructions. In one example, memory 140 may store, load, and/or maintain one or more of modules 102. Examples of memory 140 include, without limitation, Random Access Memory (RAM), Read Only Memory (ROM), flash memory, Hard Disk Drives (HDDs), Solid-State Drives (SSDs), optical disk drives, caches, variations or combinations of one or more of the same, and/or any other suitable storage memory.

As illustrated in FIG. 1, example system 100 may also include one or more physical processors, such as physical processor 130. Physical processor 130 generally represents any type or form of hardware-implemented processing unit capable of interpreting and/or executing computer-readable instructions. In one example, physical processor 130 may access and/or modify one or more of modules 102 stored in memory 140. Additionally or alternatively, physical processor 130 may execute one or more of modules 102 to facilitate controlling access. Examples of physical processor 130 include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, and/or any other suitable physical processor.

Example system 100 in FIG. 1 may be implemented in a variety of ways. For example, all or a portion of example system 100 may represent portions of example system 200 in FIG. 2. As shown in FIG. 2, system 200 may include a computing device 202 in communication with a server 206 via a network 204. In one example, all or a portion of the functionality of modules 102 may be performed by computing device 202, server 206, and/or any other suitable computing system. As will be described in greater detail below, one or more of modules 102 from FIG. 1 may, when executed by at least one processor of computing device 202 and/or server 206, enable computing device 202 and/or server 206 to control access.

For example, and as will be described in greater detail below, installation module 104 may install on a personal mobile device, such as computing device 202, a mobile device application 210 that enforces authorization security policy 122 for protected premises, such as corporate premises protected by an access card system, as discussed further below. Checking module 106 may check, as part of mobile device application 210 and in response to installing the mobile device application, whether the personal mobile device satisfies a condition of authorization security policy 122. Granting module may grant authorization for the personal mobile device to function as an access card based on a result of checking whether the personal mobile device satisfies the condition of authorization security policy 122. Additionally, enforcement module 110 may enforce additional access security policy 124 on the personal mobile device after granting authorization for the personal mobile device to function as the access card.

Computing device 202 generally represents any type or form of computing device capable of reading computer-executable instructions. In some illustrative examples, computing device 202 make correspond to a personal end user mobile device, such as a smart phone or tablet, that the user may bring within premises protected by an access card system to function as an appropriate access card, as further discussed below. Additional examples of computing device 202 include, without limitation, laptops, cellular phones, Personal Digital Assistants (PDAs), multimedia players, embedded systems, wearable devices (e.g., smart watches, smart glasses, etc.), smart packaging (e.g., active or intelligent packaging), so-called Internet-of-Things devices (e.g., smart appliances, etc.), variations or combinations of one or more of the same, and/or any other suitable computing device.

Server 206 generally represents any type or form of computing device that is capable of facilitating the performance of method 300, as discussed further below. In some illustrative examples, server 206 may correspond to a back-end security server that provides, stores, maintains, and/or communicates with the mobile device application. In some examples, server 206 may provide a security service 250 that further supplies the mobile device application for download and/or installation. Additional examples of server 206 include, without limitation, security servers, application servers, web servers, storage servers, and/or database servers configured to run certain software applications and/or provide various security, web, storage, and/or database services. Although illustrated as a single entity in FIG. 2, server 206 may include and/or represent a plurality of servers that work and/or operate in conjunction with one another.

Network 204 generally represents any medium or architecture capable of facilitating communication or data transfer. In one example, network 204 may facilitate communication between computing device 202 and server 206. In this example, network 204 may facilitate communication or data transfer using wireless and/or wired connections. Examples of network 204 include, without limitation, an intranet, a Wide Area Network (WAN), a Local Area Network (LAN), a Personal Area Network (PAN), the Internet, Power Line Communications (PLC), a cellular network (e.g., a Global System for Mobile Communications (GSM) network), portions of one or more of the same, variations or combinations of one or more of the same, and/or any other suitable network.

Figure 3:
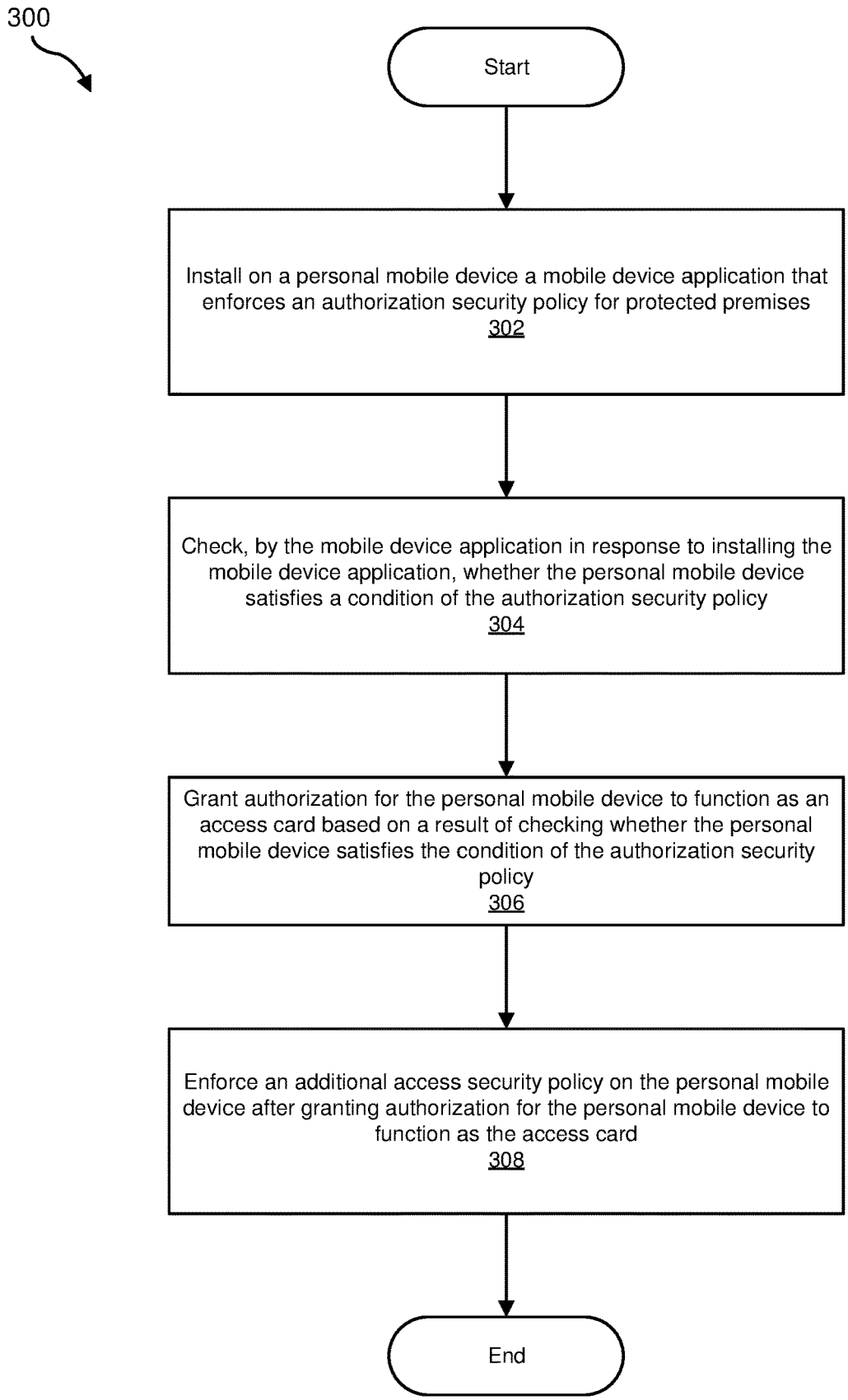
FIG. 3 is a flow diagram of an example method for controlling access.

FIG. 3 is a flow diagram of an example computer-implemented method 300 for controlling access. The steps shown in FIG. 3 may be performed by any suitable computer-executable code and/or computing system, including system 100 in FIG. 1, system 200 in FIG. 2, and/or variations or combinations of one or more of the same. In one example, each of the steps shown in FIG. 3 may represent an algorithm whose structure includes and/or is represented by multiple sub-steps, examples of which will be provided in greater detail below.

As illustrated in FIG. 3, at step 302, one or more of the systems described herein may install on a personal mobile device a mobile device application that enforces an authorization security policy for protected premises. For example, installation module 104 may, as part of computing device 202 in FIG. 2, install on computing device 202 mobile device application 210 that enforces authorization security policy 122 for protected premises, such as corporate premises protected by an access card system corresponding to method 300.

As used herein, the term "authorization security policy" at step 302 generally refers to a policy to verify, authenticate, approve, and/or register the personal mobile device in order for the personal mobile device to be approved for use as an access card on the protected premises. This process of verification, authentication, approval, and/or registering may be performed by checking module 106 in accordance with step 304, as discussed further below. Generally speaking, the authorization security policy may be applied at an entry point to the protected premises, such as protected premises that are protected by system 200. For example, a visitor or guest to a corporate environment and corresponding premises may first enter at a public entry location. At the public entry location, the visitor or guest may be prompted to download, install, and/or otherwise execute the mobile device application. Successfully executing the mobile device application may be a critical condition for enabling the personal mobile device to function as an access card to thereby provide additional access to one or more additional sublocations within the protected premises.

For example, upon successful completion of method 300, the visitor or guest may thereby be able to navigate through one or more sublocations within the protected premises. Prior to entering one or more protected sublocations within the protected premises, the visitor or guest may lift up the personal mobile device, which has been configured or registered in accordance with method 300, such that the personal mobile device effectively functions as an access card, analogous to hotel key card and related access card on premise security systems. For example, the personal mobile device may communicate with an access card reader through a display-camera interface, a near field communication link, a wireless network communication link, such as a Bluetooth connection, a speaker-microphone interface, and/or any other suitable communication link that would enable the access card reader to verify whether demonstrating possession of the personal mobile device satisfies one or more on premise security conditions that indicate whether the corresponding user has authorization to enter the corresponding sublocation.

In addition to the access card reader applying one or more security policies to determine whether demonstrating possession of the personal mobile device satisfies the on premise security conditions to enable the user to enter the sublocation, the personal mobile device itself through the mobile device application may also apply finer grained, more granular, and/or more sophisticated additional security policies locally, through the personal mobile device itself, as discussed below in connection with step 308 of method 300, which thereby improves upon related access card technology. Moreover, by shifting or relocating execution of one or more security policies onto the personal mobile device itself, rather than the access card reader and/or a corresponding external security server, the disclosed subject matter may thereby improve upon, and help to address, the privacy concerns implicated by these related access card technologies by containing one or more items of unnecessary information within the personal mobile device, rather than exposing it to the access card reader and/or the corresponding external security server, as further discussed above.

Installation module 104 may install the mobile device application in a variety of ways. In some illustrative examples, installation module 104 may install the mobile device application after first downloading the mobile device application from a security server corresponding to the access card system of method 300. For example, installation module 104 may download the mobile device application from a web server through an Internet connection, where the web server is provided by, and maintained by, a security vendor corresponding to security service 250. Additionally, or alternatively, installation module 104 may download the mobile device application through a local wireless connection corresponding to the protected premises of step 302. For example, an access point for the local wireless connection on the protected premises may provide a portal through which installation module 104 may download and install the mobile device application. Additionally, or alternatively, installation module 104 may obtain the mobile device application through any other local wireless network connection, near field network connection, endpoint-device-to-endpoint-device pairing connection, external portable memory stick or component, such as a USB memory stick, and/or any other suitable mechanism for transferring a copy of the mobile device application to computing device 202.

In some examples, authorization security policy 122 specifies a biometric security condition. For example, authorization security policy 122 may specify a fingerprint and/or other biometric condition for authorizing the user and/or the personal mobile device of the user to function as the access card in accordance with method 300.

At step 304, one or more of the systems described herein may check, by the mobile device application and in response to installing the mobile device application, whether the personal mobile device satisfies a condition of the authorization security policy. For example, checking module 106 may check, as part of computing device 202 and in response to installing the mobile device application, whether the personal mobile device satisfies a condition of the authorization security policy.

Checking module 106 may check whether the personal mobile device satisfies the condition of the authorization security policy in a variety of ways. In general, checking module 106 may check whether the personal mobile device satisfies a basic level of security conditions such that the personal mobile device may appropriately function as the access card in compliance with the overall access card system of FIG. 2. For example, checking module 106 may check whether the personal mobile device shows an indication of malware, compromise, jailbreaking, intrusion, and/or any other security threat. Similarly, checking module 106 may check one or more security settings, and/or corresponding values, of the personal mobile device to ensure that these values satisfy a baseline security profile or condition. Additionally, or alternatively, checking module 106 may check whether the personal mobile device indicates markers or identifying items of information that correspond to one or more users, guests, visitors, employees, and/or other persons who were previously authorized to register the personal mobile device with the access card system of FIG. 2 (e.g., authorized by security service 250, authorized by employees or security agents located at the entry point for the protected premises, and/or authorized by the corresponding organization or corporation or other owner of the protected premises). For example, checking module 106 may check one or more device identifiers, component identifiers, serial numbers, encryption keys, passwords, security tokens, and/or any other suitable markers or identifying items of information that may be used to match the personal mobile device to one or more persons authorized to register their respective personal mobile device with the access card system.

In some examples, if checking module 106 determines that the personal mobile device fails to satisfy one or more security conditions, checking module 106 may also optionally prompt the user to remedy this failure, such as by modifying one or more settings of the personal mobile device, to thereby enable the user to proceed in accordance with method 300. Upon checking module 106 determining that the personal mobile device successfully satisfies the checking procedure, such that the personal mobile device indicates a baseline level of security that complies with the corresponding access card security system, checking module 106 may accordingly register the personal mobile device and further trigger granting module 108 to grant authorization for the personal mobile device to function as an access card in accordance with step 306, as discussed in more detail below.

At step 306, one or more of the systems described herein may grant authorization for the personal mobile device to function as an access card based on a result of checking whether the personal mobile device satisfies the condition of the authorization security policy. For example, granting module 108 may, as part of computing device 202 in FIG. 2, grant authorization for computing device 202 to function as an access card based on a result of checking whether computing device 202 satisfies the condition of authorization security policy 122.

Generally speaking, granting module 108 may grant authorization for the personal mobile device to function as the access card based on checking module 106 determining that the personal mobile device satisfies the authorization security policy, as further discussed above. Alternatively, if checking module 106 determines at step 304 that the personal mobile device failed to satisfy the authorization security policy, then granting module 108 may positively deny authorization such that the personal mobile device cannot be used as an access card to access one or more sublocations within the protected premises.

Granting module 108 may grant authorization for the personal mobile device to function as the access card at least in part by configuring one or more settings or items of information within the mobile device application such that this information may be displayed or communicated to one or more access card readers on the protected premises to enable the access card readers to grant entry to one or more sublocations on the protected premises. Additionally, or alternatively, granting module 108 may grant authorization by communicating one or more items of information identifying the personal mobile device, without necessarily modifying one or more items of information on the personal mobile device, such that one or more access card readers on the protected premises may receive communications of these items of identifying information and thereby detect that the corresponding personal mobile device is authorized (or not authorized) to enter one or more sublocations within the protected premises based on the particularities of the corresponding security policies, as discussed in more detail below.

In addition to the above, in some examples, granting module 108 may grant authorization by configuring the mobile device application to communicate the grant of authorization to a corresponding access card reader. In these scenarios, the access card reader may be configured optionally to simply trust the indication of authorization from the personal mobile device due to the personal mobile device previously having been registered and verified as trusted in accordance with steps 302-306, as further discussed above. Alternatively, the access card reader may optionally maintain one or more levels of autonomy such that it independently applies one or more of its own security policies in order to determine whether the personal mobile device is authorized to grant access to corresponding sublocations, without necessarily trusting one or more indications of authorization or lack of authorization from the personal mobile device itself.

At step 308, one or more of the systems described herein may enforce an additional access security policy on the personal mobile device after granting authorization for the personal mobile device to function as the access card. For example, enforcement module 110 may, as part of computing device 202 in FIG. 2, enforce access security policy 124 on the personal mobile device after granting authorization for the personal mobile device to function as the access card. As used herein, the term "additional access security policy" or "access security policy 124" generally refers to a security policy that is applied locally by the mobile device application on the personal mobile device itself so as to provide an additional layer of security or protection, which might otherwise be provided or enforced by an external security server within related or conventional access card systems. In view of the above, (i) the additional access security policy is thereby distinguished from both (ii) the authorization security policy (which is the policy of step 302, and which specifies whether the personal mobile device is even authorized to function as an access card and/or (iii) any additional security policy applied by one or more access card readers on the protected premises, as further discussed above. Of course, in some examples, two or more of these three separate security policies may overlap in substance or function, or otherwise interact.

Enforcement module 110 may enforce the additional access security policy in a variety of ways. For example, enforcement module 110 may enforce the additional access security policy on the personal mobile device at least in part by dynamically enforcing a sublocation-specific condition within the protected premises protected by the mobile device application based on the mobile device application detecting that a location of the personal mobile device matches the sublocation-specific condition. Additionally, or alternatively, in some examples the additional access security policy specifies varying location-specific security conditions for differing locations within the protected premises protected by the mobile device application. Furthermore, in these examples, the mobile device application applies the location-specific security conditions dynamically based on location information indicating a location of the personal mobile device that was detected by the personal mobile device. Optionally, in these examples, the mobile device application applies the location-specific security conditions dynamically without providing the location information indicating the location of the personal mobile device to an external security server to protect the privacy of a user of the personal mobile device by keeping the location information contained within the personal mobile device rather than exposing the location information to the external security server and/or one or more access card readers. In other words, in these examples optionally the personal mobile device keeps private and contained within the personal mobile device the same location-specific information that the mobile device application uses to dynamically apply location-specific security policies, such that the personal mobile device itself contains the information indicating which location-specific security policy to apply, based on where the personal mobile device is currently located, without the same location or behavioral information being necessarily exposed to one or more external security servers and/or access card readers.

Figure 4:
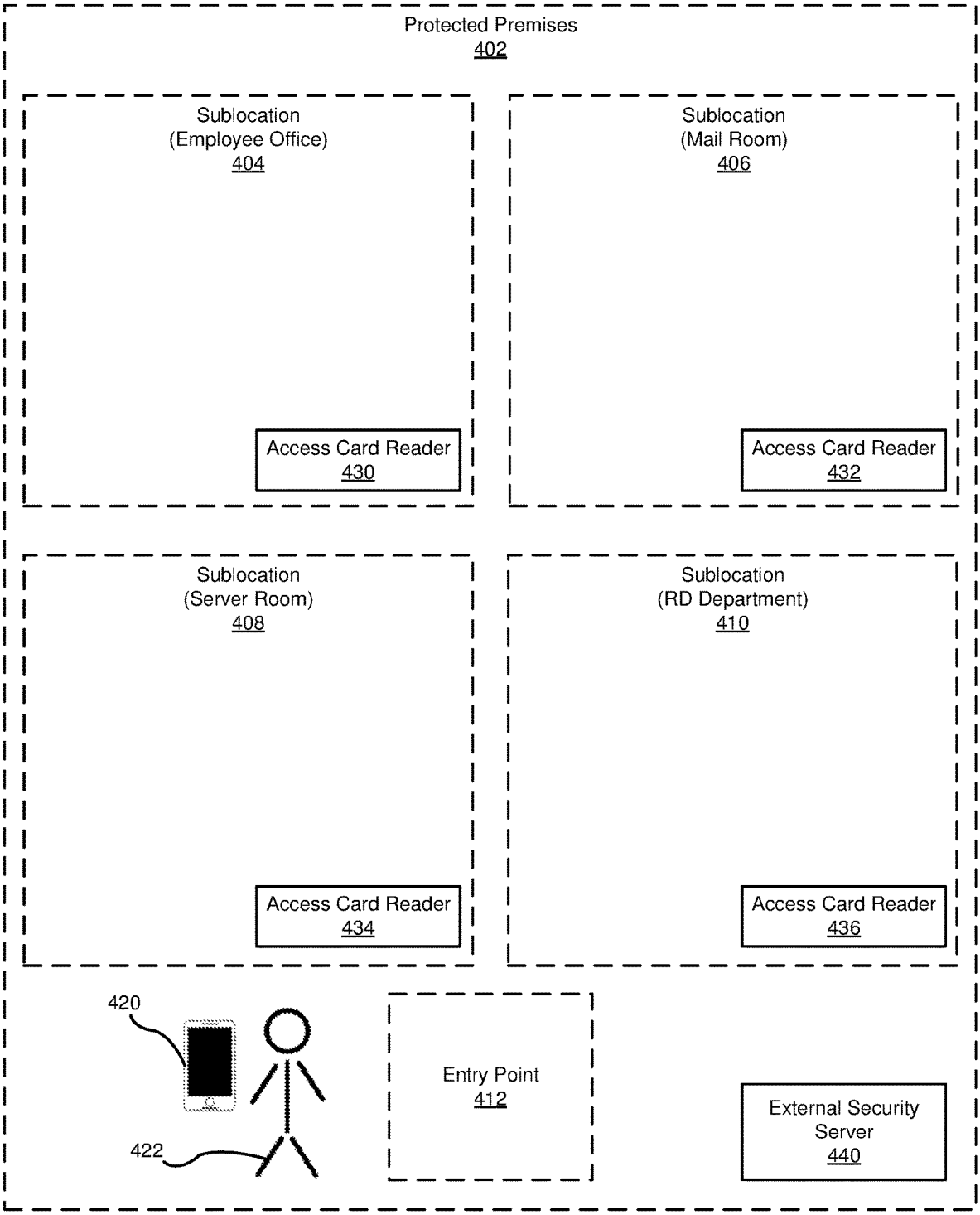
FIG. 4 is a block diagram of an example workflow corresponding to systems and methods for controlling access.

FIG. 4 shows an example illustration of a workflow corresponding to the performance of method 300, as further discussed above. As further shown in this figure, protected premises 402, which may correspond to any location or set of locations protected through the performance of method 300, such as a corporate environment protected by an access card security system, may further include a number of different sublocations. More specifically, this figure shows illustrative examples of such sublocations, such as a sublocation 404, which may correspond to an employee office, a sublocation 406, which may correspond to the mailroom, a sublocation 408, which may correspond to the server room, and/or a sublocation 410, which may correspond to a research and development ("RD") department. Additionally, this figure further shows that each one of these sublocations may optionally further include, either internally or on the exterior to monitor and control access, one or more access card readers, including respectively access card readers 430-436. Moreover, this figure also further illustrates how protected premises 402 may optionally include an entry point 412, which may correspond for example to the public entry point of a corporate, government, organizational, home, personal, and/or other environment or protected premises, whereby an employee, visitor, guest, user, and/or other person may first enter and then proceed through one or more security checks in order to potentially receive, configure, and/or register one or more access cards to thereby further access one or more sublocations within the protected premises.

Moreover, this figure also further illustrates an example user 422 and a corresponding personal mobile device 420 owned and/or possessed by user 422, which may correspond to computing device 202, as further discussed above. Upon entering entry point 412, user 422 may install the mobile device application, in accordance with steps 302-304 of method 300, thereby registering the user's own personal mobile device to thereby function as an access card for accessing one or more sublocations within the protected premises in accordance with the overall access location security policies applied on protected premises 402. As further outlined above, some or all of the access location security policies may be applied locally by the personal mobile device, thereby containing and compartmentalizing one or more items of sensitive personal information, such as location and/or behavioral information, within the personal mobile device rather than exposing this information to one or more external security servers and/or access card readers.

Lastly, this figure also illustrates how protected premises 402 may further include an external security server 440, which is external in the sense that it is external to personal mobile device 420, and which may correspond to the external security server discussed extensively above, and which may also correspond to server 206 of FIG. 2. In some examples, external security server 440 may function as a wireless or other network management server, such as a backend security server that maintains and/or manages one or more components of the overall access card system. Accordingly, external security server 440 may optionally communicate with one or more access card readers, such as those shown in this figure. In these examples, one or more of the access card readers may optionally deny, block, omit, fail to transfer, or prevent from receiving, one or more items of location and/or behavior information to the external security server.

Alternatively, in other examples external security server 440 may lack or omit communication with one or more access card readers, thereby further protecting the privacy of the user's location and behavior information while on the protected premises, while nevertheless locally enforcing sublocation-specific security policies through personal mobile device 420 and/or the local access card readers themselves. As further discussed above and also further discussed below, in these examples, external security server 440 may optionally lack, omit, not receive, not record, not use, and/or not analyze one or more items of location and/or behavioral information, such as information from a geolocation sensor component of personal mobile device 420, etc. For example, in some scenarios personal mobile device 420 may not even establish one or more connections to external security server 440 and/or may only establish an initial and temporary connection in order to download and install the mobile device application while also subsequently, and optionally, terminating this initial and temporary connection, thereby further protecting the privacy of the user's location and behavior information.

In the example of FIG. 4, performing method 300 may enable personal mobile device 420 to dynamically apply different and varying additional access security policies, corresponding to additional access security policy 124 of step 308, based on the sublocation, or other location information, detected by personal mobile device 420 when navigating and/or walking through protected premises 402. For example, in one embodiment, the additional access security policy may optionally map a specific location within the protected premises protected by the mobile device application to a security condition of disabling an input device of the personal mobile device. With reference to FIG. 4, the additional access security policy may specify that personal mobile device 420 will ensure that an input device of personal mobile device 420 is disabled while the personal mobile device is located within sublocation 404 and/or after entering sublocation 404 using access card reader 430 (e.g., optionally until entering a different location using a different access card reader). Additionally, or alternatively, in one embodiment, the additional access security policy maps a specific location within the protected premises protected by the mobile device application to a security condition of disabling a wireless network component of the personal mobile device. With reference to FIG. 4, the additional access security policy may specify that personal mobile device 420 will ensure that a wireless network component of the personal mobile device is disabled while the personal mobile device is located within sublocation 406 and/or after entering sublocation 406 using access card reader 432 (e.g., optionally until entering a different location using a different access card reader). Of course, system 200 may optionally apply one or more different or varying access security policies to sublocation 408 and/or sublocation 410 and their respective access card readers. Moreover, these varying access security policies may be tailored to address the specific security desires, needs, and/or preferences corresponding to the different features or characteristics of these different sublocations (e.g., the mailroom indicates a different set of security policies appropriate for that sublocation than the server room indicates).

Generally speaking, the owners and/or management of protected premises 402 may use any suitable and/or arbitrary combination of security conditions and/or sublocation-specific security policies to appropriately and dynamically protect the different sublocations within protected premises 402 based on their own personal preferences and/or security system needs or desires. Moreover, as further outlined above the additional security access policy may be applied locally by the personal mobile device itself, which thereby provides an additional, and distinct, layer of security and/or privacy protection that supplements the authentication security policy of step 302 and/or any other distinct access security policy applied by one or more access card readers, such as those shown in FIG. 4.

Additionally, or alternatively, the mobile device application may prevent the external security server protecting the protected premises from consuming information indicating a location of the personal mobile device that is more specific than access card entry information. As used herein, the term "access card entry information" generally refers to information simply indicating the timing and/or number of successful and/or unsuccessful attempts to access one or more sublocations within the protected premises using one or more access card readers in connection or communication with the personal mobile device, as further discussed above, as well as one or more items of information identifying the specific personal mobile devices and/or the specific access card readers where these interactions took place. In some examples, one or more external security servers, such as server 206, which may be maintaining or facilitating the performance of method 300 and/or managing the overall access card reader system on the protected premises, may not receive, store, analyze, and/or use one or more items of additional location information regarding the location of the user and/or otherwise indicating the behavior of the user. Illustrative examples of these additional items of location information may include local wireless network connection information, Internet or wide area network connection information, geolocation detection component information, and/or any other item of information from an additional input component on the personal mobile device, such as a microphone, a camera, etc.

In some examples, the external security server to which the personal mobile device optionally connects does not consume information indicating a more specific and granular location of the personal mobile device than information indicating a sublocation that a user of the personal mobile device attempted to access using the personal mobile device as the access card. Similarly, in some examples, the external security server may lack or omit any permutation of these items of additional information, including lacking or omitting all of these items of additional information. For example, the personal mobile device may function as the access card, in accordance with method 300, without maintaining a local wireless connection to the external security server, or any other server managing the access card system on the protected premises, and/or without maintaining a wide area network or Internet connection to a corresponding external security server. Alternatively, in some examples the personal mobile device may maintain one or more wireless network connections, but these connections may be external to, and independent of, one or more external security servers that are maintaining the access card system of FIG. 2 and method 300 such that these external security servers are effectively denied this additional information, thereby further protecting and enhancing the privacy of the user and the user's personal mobile device.

Furthermore, in other alternative examples, the personal mobile device may maintain one or more wireless network connections with the on premise external security server, and yet the mobile device application may intentionally block, fail to transmit, and/or prevent the external security server from receiving one or more sets of this additional location and/or behavior information, such as geolocation sensor detection information, wireless network information including optionally triangulation information, camera and/or microphone information, and/or any other information on the personal mobile device that might compromise the privacy of the user if exposed to another server computing device external to the personal mobile device. These additional items of privacy-compromising information may include user files stored on the personal mobile device and corresponding metadata, web browsing history and metadata, text message history and metadata, social network postings, communications, and social graph information, download information, installed or deleted applications and corresponding user data, application access privileges, operating system settings and configuration, telephone call history and metadata, and/or personal mobile device contact information, etc.

Additionally, or alternatively, in some examples, enforcement module 110 may enforce the additional access security policy at least in part through a push notification that is triggered through a local wireless network beacon. For example, a sublocation within the protected premises may include a wireless access point that serves as a centralized security point for applying a sublocation-specific policy that corresponds to that sublocation. The wireless access point may transmit a local wireless network beacon packet, or other item of network information, which may be received by a local wireless network antenna or component within the personal mobile device. In response to detecting the specific networked beacon packet, or other item of information, the mobile device application may be triggered to apply one or more security conditions and/or policies specified, or indicated, by the corresponding network communication.

Figure 5:
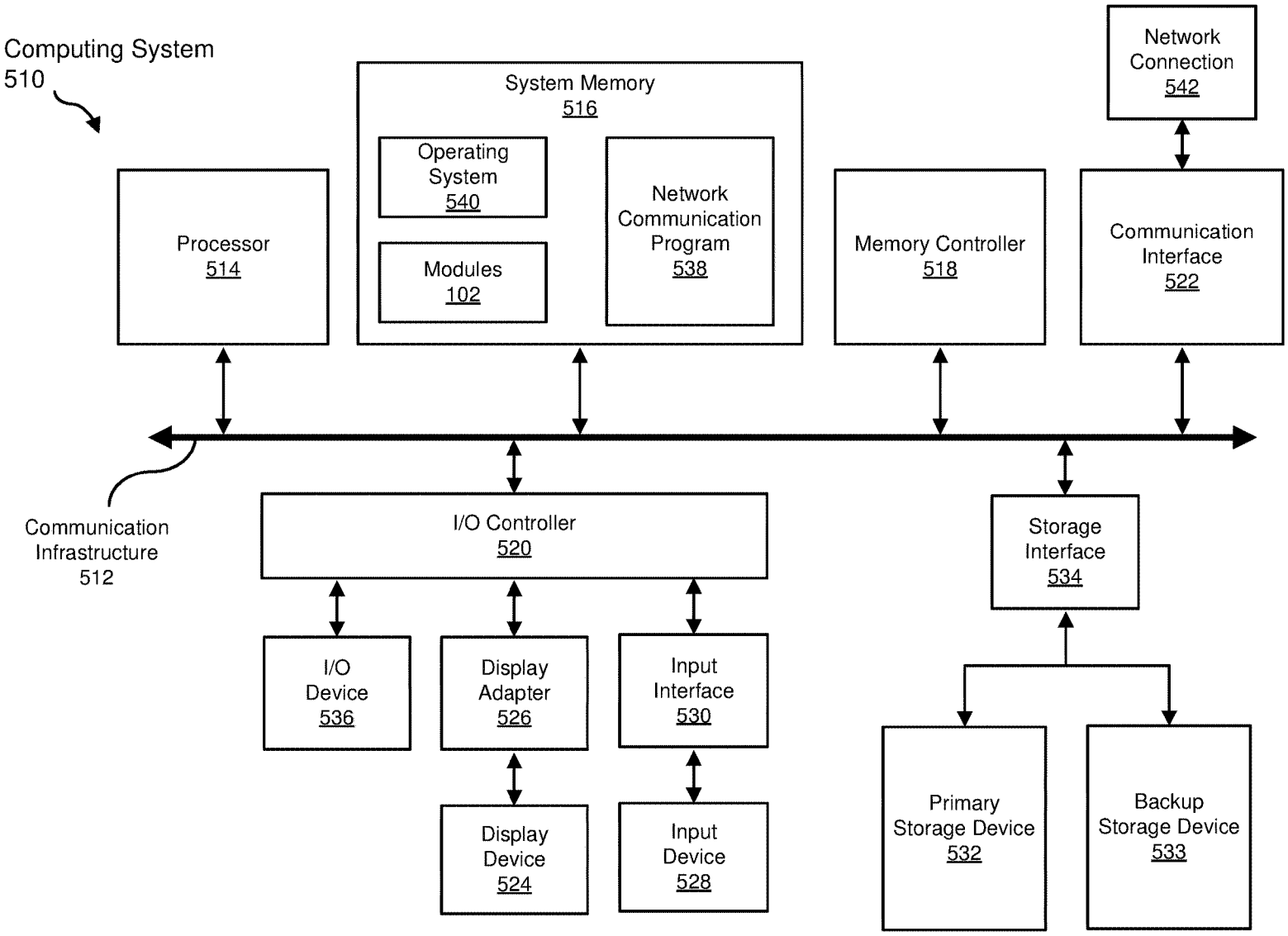
FIG. 5 is a block diagram of an example computing system capable of implementing one or more of the embodiments described and/or illustrated herein.

FIG. 5 is a block diagram of an example computing system 510 capable of implementing one or more of the embodiments described and/or illustrated herein. For example, all or a portion of computing system 510 may perform and/or be a means for performing, either alone or in combination with other elements, one or more of the steps described herein (such as one or more of the steps illustrated in FIG. 3). All or a portion of computing system 510 may also perform and/or be a means for performing any other steps, methods, or processes described and/or illustrated herein.

Computing system 510 broadly represents any single or multi-processor computing device or system capable of executing computer-readable instructions. Examples of computing system 510 include, without limitation, workstations, laptops, client-side terminals, servers, distributed computing systems, handheld devices, or any other computing system or device. In its most basic configuration, computing system 510 may include at least one processor 514 and a system memory 516.

Processor 514 generally represents any type or form of physical processing unit (e.g., a hardware-implemented central processing unit) capable of processing data or interpreting and executing instructions. In certain embodiments, processor 514 may receive instructions from a software application or module. These instructions may cause processor 514 to perform the functions of one or more of the example embodiments described and/or illustrated herein.

System memory 516 generally represents any type or form of volatile or non-volatile storage device or medium capable of storing data and/or other computer-readable instructions. Examples of system memory 516 include, without limitation, Random Access Memory (RAM), Read Only Memory (ROM), flash memory, or any other suitable memory device. Although not required, in certain embodiments computing system 510 may include both a volatile memory unit (such as, for example, system memory 516) and a non-volatile storage device (such as, for example, primary storage device 532, as described in detail below). In one example, one or more of modules 102 from FIG. 1 may be loaded into system memory 516.

In some examples, system memory 516 may store and/or load an operating system 540 for execution by processor 514. In one example, operating system 540 may include and/or represent software that manages computer hardware and software resources and/or provides common services to computer programs and/or applications on computing system 510. Examples of operating system 540 include, without limitation, LINUX, JUNOS, MICROSOFT WINDOWS, WINDOWS MOBILE, MAC OS, APPLE'S 10S, UNIX, GOOGLE CHROME OS, GOOGLE'S ANDROID, SOLARIS, variations of one or more of the same, and/or any other suitable operating system.

In certain embodiments, example computing system 510 may also include one or more components or elements in addition to processor 514 and system memory 516. For example, as illustrated in FIG. 5, computing system 510 may include a memory controller 518, an Input/Output (I/O) controller 520, and a communication interface 522, each of which may be interconnected via a communication infrastructure 512. Communication infrastructure 512 generally represents any type or form of infrastructure capable of facilitating communication between one or more components of a computing device. Examples of communication infrastructure 512 include, without limitation, a communication bus (such as an Industry Standard Architecture (ISA), Peripheral Component Interconnect (PCI), PCI Express (PCIe), or similar bus) and a network.

Memory controller 518 generally represents any type or form of device capable of handling memory or data or controlling communication between one or more components of computing system 510. For example, in certain embodiments memory controller 518 may control communication between processor 514, system memory 516, and I/O controller 520 via communication infrastructure 512.

I/O controller 520 generally represents any type or form of module capable of coordinating and/or controlling the input and output functions of a computing device. For example, in certain embodiments I/O controller 520 may control or facilitate transfer of data between one or more elements of computing system 510, such as processor 514, system memory 516, communication interface 522, display adapter 526, input interface 530, and storage interface 534.

As illustrated in FIG. 5, computing system 510 may also include at least one display device 524 coupled to I/O controller 520 via a display adapter 526. Display device 524 generally represents any type or form of device capable of visually displaying information forwarded by display adapter 526. Similarly, display adapter 526 generally represents any type or form of device configured to forward graphics, text, and other data from communication infrastructure 512 (or from a frame buffer, as known in the art) for display on display device 524.

As illustrated in FIG. 5, example computing system 510 may also include at least one input device 528 coupled to I/O controller 520 via an input interface 530. Input device 528 generally represents any type or form of input device capable of providing input, either computer or human generated, to example computing system 510. Examples of input device 528 include, without limitation, a keyboard, a pointing device, a speech recognition device, variations or combinations of one or more of the same, and/or any other input device.

Additionally or alternatively, example computing system 510 may include additional I/O devices. For example, example computing system 510 may include I/O device 536. In this example, I/O device 536 may include and/or represent a user interface that facilitates human interaction with computing system 510. Examples of I/O device 536 include, without limitation, a computer mouse, a keyboard, a monitor, a printer, a modem, a camera, a scanner, a microphone, a touchscreen device, variations or combinations of one or more of the same, and/or any other I/O device.

Communication interface 522 broadly represents any type or form of communication device or adapter capable of facilitating communication between example computing system 510 and one or more additional devices. For example, in certain embodiments communication interface 522 may facilitate communication between computing system 510 and a private or public network including additional computing systems. Examples of communication interface 522 include, without limitation, a wired network interface (such as a network interface card), a wireless network interface (such as a wireless network interface card), a modem, and any other suitable interface. In at least one embodiment, communication interface 522 may provide a direct connection to a remote server via a direct link to a network, such as the Internet. Communication interface 522 may also indirectly provide such a connection through, for example, a local area network (such as an Ethernet network), a personal area network, a telephone or cable network, a cellular telephone connection, a satellite data connection, or any other suitable connection.

In certain embodiments, communication interface 522 may also represent a host adapter configured to facilitate communication between computing system 510 and one or more additional network or storage devices via an external bus or communications channel. Examples of host adapters include, without limitation, Small Computer System Interface (SCSI) host adapters, Universal Serial Bus (USB) host adapters, Institute of Electrical and Electronics Engineers (IEEE) 1394 host adapters, Advanced Technology Attachment (ATA), Parallel ATA (PATA), Serial ATA (SATA), and External SATA (eSATA) host adapters, Fibre Channel interface adapters, Ethernet adapters, or the like. Communication interface 522 may also allow computing system 510 to engage in distributed or remote computing. For example, communication interface 522 may receive instructions from a remote device or send instructions to a remote device for execution.

In some examples, system memory 516 may store and/or load a network communication program 538 for execution by processor 514. In one example, network communication program 538 may include and/or represent software that enables computing system 510 to establish a network connection 542 with another computing system (not illustrated in FIG. 5) and/or communicate with the other computing system by way of communication interface 522. In this example, network communication program 538 may direct the flow of outgoing traffic that is sent to the other computing system via network connection 542. Additionally or alternatively, network communication program 538 may direct the processing of incoming traffic that is received from the other computing system via network connection 542 in connection with processor 514.

Although not illustrated in this way in FIG. 5, network communication program 538 may alternatively be stored and/or loaded in communication interface 522. For example, network communication program 538 may include and/or represent at least a portion of software and/or firmware that is executed by a processor and/or Application Specific Integrated Circuit (ASIC) incorporated in communication interface 522.

As illustrated in FIG. 5, example computing system 510 may also include a primary storage device 532 and a backup storage device 533 coupled to communication infrastructure 512 via a storage interface 534. Storage devices 532 and 533 generally represent any type or form of storage device or medium capable of storing data and/or other computer-readable instructions. For example, storage devices 532 and 533 may be a magnetic disk drive (e.g., a so-called hard drive), a solid state drive, a floppy disk drive, a magnetic tape drive, an optical disk drive, a flash drive, or the like. Storage interface 534 generally represents any type or form of interface or device for transferring data between storage devices 532 and 533 and other components of computing system 510.

In certain embodiments, storage devices 532 and 533 may be configured to read from and/or write to a removable storage unit configured to store computer software, data, or other computer-readable information. Examples of suitable removable storage units include, without limitation, a floppy disk, a magnetic tape, an optical disk, a flash memory device, or the like. Storage devices 532 and 533 may also include other similar structures or devices for allowing computer software, data, or other computer-readable instructions to be loaded into computing system 510. For example, storage devices 532 and 533 may be configured to read and write software, data, or other computer-readable information. Storage devices 532 and 533 may also be a part of computing system 510 or may be a separate device accessed through other interface systems.

Many other devices or subsystems may be connected to computing system 510. Conversely, all of the components and devices illustrated in FIG. 5 need not be present to practice the embodiments described and/or illustrated herein. The devices and subsystems referenced above may also be interconnected in different ways from that shown in FIG. 5. Computing system 510 may also employ any number of software, firmware, and/or hardware configurations. For example, one or more of the example embodiments disclosed herein may be encoded as a computer program (also referred to as computer software, software applications, computer-readable instructions, or computer control logic) on a computer-readable medium. The term "computer-readable medium," as used herein, generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The computer-readable medium containing the computer program may be loaded into computing system 510. All or a portion of the computer program stored on the computer-readable medium may then be stored in system memory 516 and/or various portions of storage devices 532 and 533. When executed by processor 514, a computer program loaded into computing system 510 may cause processor 514 to perform and/or be a means for performing the functions of one or more of the example embodiments described and/or illustrated herein. Additionally or alternatively, one or more of the example embodiments described and/or illustrated herein may be implemented in firmware and/or hardware. For example, computing system 510 may be configured as an Application Specific Integrated Circuit (ASIC) adapted to implement one or more of the example embodiments disclosed herein.

Figure 6:
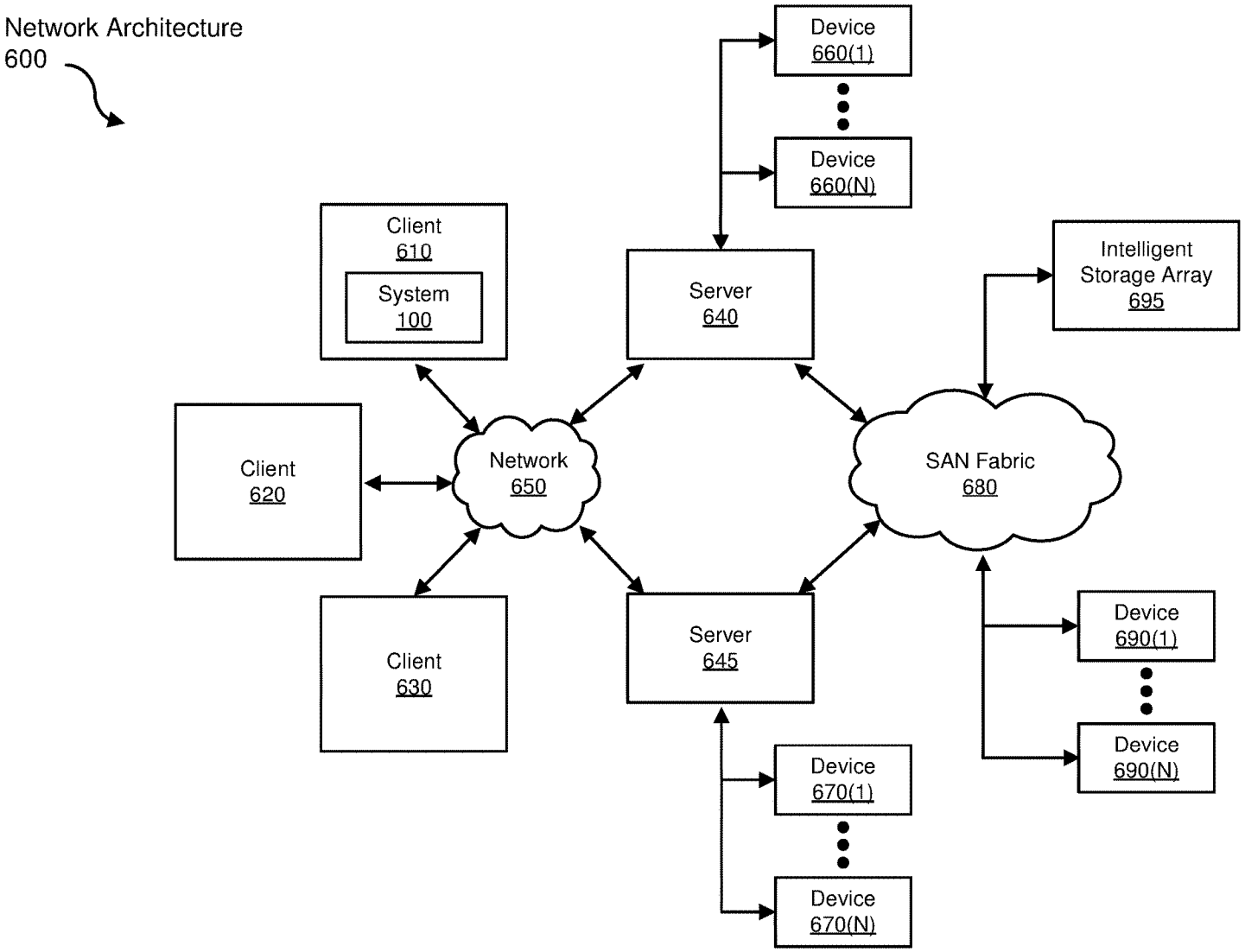
FIG. 6 is a block diagram of an example computing network capable of implementing one or more of the embodiments described and/or illustrated herein.

FIG. 6 is a block diagram of an example network architecture 600 in which client systems 610, 620, and 630 and servers 640 and 645 may be coupled to a network 650. As detailed above, all or a portion of network architecture 600 may perform and/or be a means for performing, either alone or in combination with other elements, one or more of the steps disclosed herein (such as one or more of the steps illustrated in FIG. 3). All or a portion of network architecture 600 may also be used to perform and/or be a means for performing other steps and features set forth in the instant disclosure.

Client systems 610, 620, and 630 generally represent any type or form of computing device or system, such as example computing system 510 in FIG. 5. Similarly, servers 640 and 645 generally represent computing devices or systems, such as application servers or database servers, configured to provide various database services and/or run certain software applications. Network 650 generally represents any telecommunication or computer network including, for example, an intranet, a WAN, a LAN, a PAN, or the Internet. In one example, client systems 610, 620, and/or 630 and/or servers 640 and/or 645 may include all or a portion of system 100 from FIG. 1.

As illustrated in FIG. 6, one or more storage devices 660(1)-(N) may be directly attached to server 640. Similarly, one or more storage devices 670(*i*)-(N) may be directly attached to server 645. Storage devices 660(*i*)-(N) and storage devices 670(*i*)-(N) generally represent any type or form of storage device or medium capable of storing data and/or other computer-readable instructions. In certain embodiments, storage devices 660(*i*)-(N) and storage devices 670(*i*)-(N) may represent Network-Attached Storage (NAS) devices configured to communicate with servers 640 and 645 using various protocols, such as Network File System (NFS), Server Message Block (SMB), or Common Internet File System (CIFS).

Servers 640 and 645 may also be connected to a Storage Area Network (SAN) fabric 680. SAN fabric 680 generally represents any type or form of computer network or architecture capable of facilitating communication between a plurality of storage devices. SAN fabric 680 may facilitate communication between servers 640 and 645 and a plurality of storage devices 690(*i*)-(N) and/or an intelligent storage array 695. SAN fabric 680 may also facilitate, via network 650 and servers 640 and 645, communication between client systems 610, 620, and 630 and storage devices 690(1)-(N) and/or intelligent storage array 695 in such a manner that devices 690(*i*)-(N) and array 695 appear as locally attached devices to client systems 610, 620, and 630. As with storage devices 660(1)-(N) and storage devices 670(*i*)-(N), storage devices 690(*i*)-(N) and intelligent storage array 695 generally represent any type or form of storage device or medium capable of storing data and/or other computer-readable instructions.

In certain embodiments, and with reference to example computing system 510 of FIG. 5, a communication interface, such as communication interface 522 in FIG. 5, may be used to provide connectivity between each client system 610, 620, and 630 and network 650. Client systems 610, 620, and 630 may be able to access information on server 640 or 645 using, for example, a web browser or other client software. Such software may allow client systems 610, 620, and 630 to access data hosted by server 640, server 645, storage devices 660(1)-(N), storage devices 670(1)-(N), storage devices 690(*i*)-(N), or intelligent storage array 695. Although FIG. 6 depicts the use of a network (such as the Internet) for exchanging data, the embodiments described and/or illustrated herein are not limited to the Internet or any particular network-based environment.

In at least one embodiment, all or a portion of one or more of the example embodiments disclosed herein may be encoded as a computer program and loaded onto and executed by server 640, server 645, storage devices 660(*i*)-(N), storage devices 670(*i*)-(N), storage devices 690(*i*)-(N), intelligent storage array 695, or any combination thereof. All or a portion of one or more of the example embodiments disclosed herein may also be encoded as a computer program, stored in server 640, run by server 645, and distributed to client systems 610, 620, and 630 over network 650.

As detailed above, computing system 510 and/or one or more components of network architecture 600 may perform and/or be a means for performing, either alone or in combination with other elements, one or more steps of an example method for controlling access.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered example in nature since many other architectures can be implemented to achieve the same functionality.

In some examples, all or a portion of example system 100 in FIG. 1 may represent portions of a cloud-computing or network-based environment. Cloud-computing environments may provide various services and applications via the Internet. These cloud-based services (e.g., software as a service, platform as a service, infrastructure as a service, etc.) may be accessible through a web browser or other remote interface. Various functions described herein may be provided through a remote desktop environment or any other cloud-based computing environment.

In various embodiments, all or a portion of example system 100 in FIG. 1 may facilitate multi-tenancy within a cloud-based computing environment. In other words, the software modules described herein may configure a computing system (e.g., a server) to facilitate multi-tenancy for one or more of the functions described herein. For example, one or more of the software modules described herein may program a server to enable two or more clients (e.g., customers) to share an application that is running on the server. A server programmed in this manner may share an application, operating system, processing system, and/or storage system among multiple customers (i.e., tenants). One or more of the modules described herein may also partition data and/or configuration information of a multi-tenant application for each customer such that one customer cannot access data and/or configuration information of another customer.

According to various embodiments, all or a portion of example system 100 in FIG. 1 may be implemented within a virtual environment. For example, the modules and/or data described herein may reside and/or execute within a virtual machine. As used herein, the term "virtual machine" generally refers to any operating system environment that is abstracted from computing hardware by a virtual machine manager (e.g., a hypervisor). Additionally or alternatively, the modules and/or data described herein may reside and/or execute within a virtualization layer. As used herein, the term "virtualization layer" generally refers to any data layer and/or application layer that overlays and/or is abstracted from an operating system environment. A virtualization layer may be managed by a software virtualization solution (e.g., a file system filter) that presents the virtualization layer as though it were part of an underlying base operating system. For example, a software virtualization solution may redirect calls that are initially directed to locations within a base file system and/or registry to locations within a virtualization layer.

In some examples, all or a portion of example system 100 in FIG. 1 may represent portions of a mobile computing environment. Mobile computing environments may be implemented by a wide range of mobile computing devices, including mobile phones, tablet computers, e-book readers, personal digital assistants, wearable computing devices (e.g., computing devices with a head-mounted display, smartwatches, etc.), and the like. In some examples, mobile computing environments may have one or more distinct features, including, for example, reliance on battery power, presenting only one foreground application at any given time, remote management features, touchscreen features, location and movement data (e.g., provided by Global Positioning Systems, gyroscopes, accelerometers, etc.), restricted platforms that restrict modifications to system-level configurations and/or that limit the ability of third-party software to inspect the behavior of other applications, controls to restrict the installation of applications (e.g., to only originate from approved application stores), etc. Various functions described herein may be provided for a mobile computing environment and/or may interact with a mobile computing environment.

In addition, all or a portion of example system 100 in FIG. 1 may represent portions of, interact with, consume data produced by, and/or produce data consumed by one or more systems for information management. As used herein, the term "information management" may refer to the protection, organization, and/or storage of data. Examples of systems for information management may include, without limitation, storage systems, backup systems, archival systems, replication systems, high availability systems, data search systems, virtualization systems, and the like.

In some embodiments, all or a portion of example system 100 in FIG. 1 may represent portions of, produce data protected by, and/or communicate with one or more systems for information security. As used herein, the term "information security" may refer to the control of access to protected data. Examples of systems for information security may include, without limitation, systems providing managed security services, data loss prevention systems, identity authentication systems, access control systems, encryption systems, policy compliance systems, intrusion detection and prevention systems, electronic discovery systems, and the like.

According to some examples, all or a portion of example system 100 in FIG. 1 may represent portions of, communicate with, and/or receive protection from one or more systems for endpoint security. As used herein, the term "endpoint security" may refer to the protection of endpoint systems from unauthorized and/or illegitimate use, access, and/or control. Examples of systems for endpoint protection may include, without limitation, anti-malware systems, user authentication systems, encryption systems, privacy systems, spam-filtering services, and the like.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

While various embodiments have been described and/or illustrated herein in the context of fully functional computing systems, one or more of these example embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the example embodiments disclosed herein.

In addition, one or more of the modules described herein may transform data, physical devices, and/or representations of physical devices from one form to another. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

The preceding description has been provided to enable others skilled in the art to best utilize various aspects of the example embodiments disclosed herein. This example description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A computer-implemented method for controlling access, at least a portion of the method being performed by a computing device comprising at least one processor, the method comprising:

installing on a personal mobile device a mobile device application that enforces an authorization security policy for protected premises;

checking, by the mobile device application and in response to installing the mobile device application, whether the personal mobile device satisfies a condition of the authorization security policy;

granting authorization for the personal mobile device to function as an access card based on a result of checking whether the personal mobile device satisfies the condition of the authorization security policy; and enforcing an additional access security policy on the personal mobile device after granting authorization for the personal mobile device to function as the access card;

wherein the additional access security policy maps a specific location within the protected premises protected by the mobile device application to a security condition of disabling an input device of the personal mobile device.

2. The computer-implemented method of claim 1, wherein enforcing the additional access security policy on the personal mobile device includes dynamically enforcing a sublocation-specific condition within the protected premises protected by the mobile device application based on the mobile device application detecting that a location of the personal mobile device matches the sublocation-specific condition.

3. The computer-implemented method of claim 1, wherein an external security server to which the personal mobile device connects does not consume information indicating a more specific and granular location of the personal mobile device than information indicating a sublocation that a user of the personal mobile device attempted to access using the personal mobile device as the access card.

4. The computer-implemented method of claim 1, wherein:

the additional access security policy specifies varying location-specific security conditions for differing locations within the protected premises protected by the mobile device application; and the mobile device application applies the location-specific security conditions dynamically based on location information indicating a location of the personal mobile device that was detected by the personal mobile device.

5. The computer-implemented method of claim 4, wherein the mobile device application applies the location-specific security conditions dynamically without providing the location information indicating the location of the personal mobile device to an external security server to protect the privacy of a user of the personal mobile device by keeping the location information contained within the personal mobile device rather than exposing the location information to the external security server.

6. The computer-implemented method of claim 1, wherein the mobile device application prevents an external security server protecting the protected premises from consuming information indicating a location of the personal mobile device that is more specific than access card entry information.

7. The computer-implemented method of claim 1, wherein the input device comprises a microphone.

8. The computer-implemented method of claim 1, wherein the additional access security policy maps the specific location within the protected premises protected by the mobile device application to a security condition of disabling a wireless network component of the personal mobile device.

9. The computer-implemented method of claim 1, wherein enforcing the additional access security policy is enabled through a push notification that is triggered through a local wireless network beacon.

10. The computer-implemented method of claim 1, wherein the authorization security policy specifies a biometric security condition.

11. A system for controlling access, the system comprising:

an installation module, stored in memory, that installs on a personal mobile device a mobile device application that enforces an authorization security policy for protected premises;

a checking module, stored in memory, that checks, as part of the mobile device application and in response to installing the mobile device application, whether the personal mobile device satisfies a condition of the authorization security policy;

a granting module, stored in memory, that grants authorization for the personal mobile device to function as an access card based on a result of checking whether the personal mobile device satisfies the condition of the authorization security policy;

an enforcement module, stored in memory, that enforces an additional access security policy on the personal mobile device after granting authorization for the personal mobile device to function as the access card; and at least one physical processor configured to execute the installation module, the checking module, the granting module, and the enforcement module;

wherein the additional access security policy maps a specific location within the protected premises protected by the mobile device application to a security condition of disabling an input device of the personal mobile device.

12. The system of claim 11, wherein the enforcement module enforces the additional access security policy on the personal mobile device at least in part by dynamically enforcing a sublocation-specific condition within the protected premises protected by the mobile device application based on the mobile device application detecting that a location of the personal mobile device matches the sublocation-specific condition.

13. The system of claim 11, wherein an external security server to which the personal mobile device connects does not consume information indicating a more specific and granular location of the personal mobile device than information indicating a sublocation that a user of the personal mobile device attempted to access using the personal mobile device as the access card.

14. The system of claim 11, wherein:

the additional access security policy specifies varying location-specific security conditions for differing locations within the protected premises protected by the mobile device application; and the mobile device application applies the location-specific security conditions dynamically based on location information indicating a location of the personal mobile device that was detected by the personal mobile device.

15. The system of claim 14, wherein the mobile device application applies the location-specific security conditions dynamically without providing the location information indicating the location of the personal mobile device to an external security server to protect the privacy of a user of the personal mobile device by keeping the location information contained within the personal mobile device rather than exposing the location information to the external security server.

16. The system of claim 11, wherein the mobile device application prevents an external security server protecting the protected premises from consuming information indicating a location of the personal mobile device that is more specific than access card entry information.

17. The system of claim 11, wherein the input device comprises a microphone.

18. The system of claim 11, wherein the additional access security policy maps the specific location within the protected premises protected by the mobile device application to a security condition of disabling a wireless network component of the personal mobile device.

19. The system of claim 11, wherein the enforcement module enforces the additional access security policy through a push notification that is triggered through a local wireless network beacon.

20. A non-transitory computer-readable medium comprising one or more computer-readable instructions that, when executed by at least one processor of a computing device, cause the computing device to:

install on a personal mobile device a mobile device application that enforces an authorization security policy for protected premises;

check, by the mobile device application and in response to installing the mobile device application, whether the personal mobile device satisfies a condition of the authorization security policy;

grant authorization for the personal mobile device to function as an access card based on a result of checking whether the personal mobile device satisfies the condition of the authorization security policy; and enforce an additional access security policy on the personal mobile device after granting authorization for the personal mobile device to function as the access card;

wherein the additional access security policy maps a specific location within the protected premises protected by the mobile device application to a security condition of disabling an input device of the personal mobile device.

* * * * *